US008714090B2

(12) United States Patent
Pisella et al.

(10) Patent No.: US 8,714,090 B2
(45) Date of Patent: May 6, 2014

(54) TIME CONTROL DEVICE FOR THE MOVEMENT OF A MICRO-MACHINED AND SAFETY AND ARMING DEVICE COMPRISING SUCH A TIME CONTROL DEVICE

(75) Inventors: Christian Pisella, Beaucroissant (FR); Christophe Kergueris, Grenoble (FR); Laurent Reynard, Bourges (FR); Renaud Lafont, Bourges (FR); Pierre-Marie Visse, Meylan (FR)

(73) Assignee: Nexter Munitions, Versailles (FR)

( * ) Notice: Subject to any disclaimer, the term of this patent is extended or adjusted under 35 U.S.C. 154(b) by 151 days.

(21) Appl. No.: 13/358,896

(22) Filed: Jan. 26, 2012

(65) Prior Publication Data

US 2012/0192747 A1 Aug. 2, 2012

(30) Foreign Application Priority Data

Jan. 31, 2011 (FR) ..... 11 00309

(51) Int. Cl.
*F42C 15/20* (2006.01)

(52) U.S. Cl.
USPC ..... 102/257; 102/276; 102/247; 102/255; 102/264

(58) Field of Classification Search
USPC ..... 102/221–271, 276
See application file for complete search history.

(56) References Cited

U.S. PATENT DOCUMENTS 4,418,621 A * 12/1983 Rosselet ..... 102/238
5,705,767 A * 1/1998 Robinson ..... 102/231
6,064,013 A * 5/2000 Robinson ..... 200/61.53
6,167,809 B1 * 1/2001 Robinson et al. ..... 102/235
6,173,650 B1 1/2001 Garvick et al.
6,314,887 B1 * 11/2001 Robinson ..... 102/262
6,568,329 B1 5/2003 Robinson
6,622,629 B2 9/2003 Hodge et al.
7,316,186 B1 * 1/2008 Robinson et al. ..... 102/251
7,490,552 B1 2/2009 Jean et al.
7,552,681 B1 6/2009 Laib et al.
8,276,515 B1 * 10/2012 Robinson et al. ..... 102/231
8,459,184 B2 * 6/2013 Pisella et al. ..... 102/235

FOREIGN PATENT DOCUMENTS

EP 1 559 986 A1 8/2005
EP 1 559 987 A1 8/2005
EP 1 780 496 A1 5/2007
EP 2 077 431 A2 7/2009
EP 2 239 535 A1 10/2010
WO WO 2004/079290 A1 9/2004

OTHER PUBLICATIONS

Sep. 19, 2011 Search Report issued in French Patent Application No. 11.00309 (with translation).

* cited by examiner

*Primary Examiner* — Samir Abdosh
(74) *Attorney, Agent, or Firm* — Oliff PLC

(57) ABSTRACT

A time control device for the movement of a micro-machined or micro-engraved counterweight with respect to a substrate, said counterweight incorporating at least one face having at least one indentation intended to cooperate with at least one other indentation on a housing in which said counterweight moves so as to ensure the delaying of said movement of said counterweight, wherein said one indentation on said counterweight respectively on said housing receiving said counterweight is made on at least one flexible tongue itself integral with said counterweight respectively said housing, said at least one flexible tongue being able to be deformed by bending during the displacement of said counterweight.

8 Claims, 5 Drawing Sheets

TIME CONTROL DEVICE FOR THE MOVEMENT OF A MICRO-MACHINED AND SAFETY AND ARMING DEVICE COMPRISING SUCH A TIME CONTROL DEVICE

BACKGROUND OF THE INVENTION

1. Field of the Invention

The technical scope of the invention is that of micro-machined or micro-engraved devices and more particularly time control devices for the movement of a counterweight incorporated into such micro-machined device.

2. Description of the Related Art

Over the past few years, miniaturized mechanical devices have been proposed for manufacture that incorporate micro-machined or micro-engraved electro-mechanical elements, either in an element deposited on a substrate, or directly on the substrate itself. This technology, known by the acronym of MEMS (Micro Electro Mechanical) today enables micro-mechanisms to be produced implementing a technique similar to that employed in the production of electronic integrated circuits.

Numerous types of devices are made using this technique, for example sensors, accelerometers, inertial units.

It is sometimes necessary in such a micro-mechanical device to ensure the time control or braking of the movement of a mechanical organ, for example, a counterweight subjected to the action of a motor, a spring or else subject to inertial stresses.

For several years it has been known, in particular, to produce safety and arming devices for the pyrotechnic train of a projectile made using such MEMS technology.

Certain designs of such safety devices incorporate a shutter to break the pyrotechnic train, whose plane is located perpendicularly to the direction of action of this train. Such a device is disclosed, for example, in patent EP1601926. The disadvantage with such a device lies in that the thickness of the MEMS shutter is not enough to stop a pyrotechnic effect. This leads to an electrical detonator with an exploding layer (known as a "slapper") being associated with such a shutter, as described by U.S. Pat. No. 6,173,650. In this case the screen does not stop the pyrotechnic effect but prevents the projection of the plate intended to ensure the ignition of a detonation relay.

Other devices are also known in which the shutter does not break the pyrotechnic train but ensures the interruption of an optical control signal (for example, for the ignition of an explosive by laser beam). Such devices are known in particular by patents EP1559986, EP1559987.

Safety and arming devices are also known in which the shutter itself carries a pyrotechnic composition which it may introduce into the pyrotechnic train. Such devices are described, for example, by U.S. Pat. Nos. 6,622,629, 7,552,681, 7,490,552.

Lastly, devices are known in which the direction of action of the pyrotechnic train is substantially parallel to the plane of the shutter. These devices are disclosed by patents EP1780496 and EP2077431. The latter devices are particularly well adapted to safety devices for medium-caliber projectiles since they may be associated with percussion detonators.

For all known MEMS safety and arming devices the problem arises of the time control of a movement to displace a slide, a counterweight, or even the shutter itself.

It has been proposed, in particular by U.S. Pat. Nos. 6,568,329 and 6,064,013, to ensure this delay by providing slight play between the mobile counterweight and its housing and by arranging reliefs or indentations on the lateral faces of the counterweight and its housing. Given the play, when a stress appears (for example, inertial, axial or centrifugal acceleration), the indentations cooperate with one another to produce a "zigzag" movement of the counterweight, and thus a delayed or timed displacement. This is particularly useful when the arming of the device is sought to be delayed for the first 10 to 15 meters of the projectile's trajectory upon exiting the weapon, generally imposed by the safety rules applicable to projectiles.

This known solution suffers several drawbacks, however.

The zigzag movement of the counterweight is a mechanical movement that is difficult to control. This results in a degree of unreliability and a delay whose value cannot by guaranteed.

The parameters to be modified to adjust this delay are limited. An increase in the number of indentations in the counterweight will thus require the radial play to be increased thereby increasing the risk of the counterweight becoming blocked. A spring also often has to be added to control the movement of the counterweight, thereby increasing the device's complexity.

SUMMARY OF THE INVENTION

The aim of the invention is to propose a time control device for the movement of a counterweight, device wherein this movement is timed by delaying means designed so as to be able to control the delay obtained.

These delay means further enable timed counterweights to be produced that are not associated with a spring.

Thus, the invention relates to a time control device for the movement of a micro-machined or micro-engraved counterweight with respect to a substrate, the counterweight incorporating at least one face having at least one indentation intended to cooperate with at least one other indentation on a housing in which the counterweight moves so as to ensure the delaying of such movement of the counterweight, device wherein the indentation(s) on the counterweight (respectively on the housing receiving said counterweight) is (are) made on at least one flexible tongue itself integral with the counterweight (respectively the housing), the at least one flexible tongue able to be deformed by bending during the displacement of the counterweight.

The at least one flexible tongue may be integral with the counterweight (respectively the housing) by its two ends.

According to one embodiment, the counterweight is mobile in translation in a housing and incorporates two lateral faces having at least one indentation and cooperating with at least one matching indentation on the walls of the housing, at least one flexible tongue being provided near to each lateral face of the counterweight, tongue integral with the counterweight (or with the housing wall).

The device may incorporate at least two flexible tongues near each lateral face of the counterweight, tongues integral with the counterweight (or with the housing wall).

According to another embodiment, the counterweight is able to pivot in the housing and incorporates a sector with at least one indentation cooperating with one or several matching indentations integral with a flexible tongue on the housing wall.

The invention also relates to a safety and arming device for a pyrotechnic train of a projectile to which a longitudinal acceleration movement and/or an axial spin is imparted upon firing. This safety and arming device incorporates at least one counterweight whose movement is delayed by a time control device according to the invention.

Advantageously, the counterweight housing will be arranged in a shutter intended to break the pyrotechnic train.

BRIEF DESCRIPTION OF THE DRAWINGS

Other advantages will become apparent from the following description of particular embodiments, such description being made with reference to the appended drawings, in which.

DETAILED DESCRIPTION OF PREFERRED EMBODIMENTS

Figure 1:
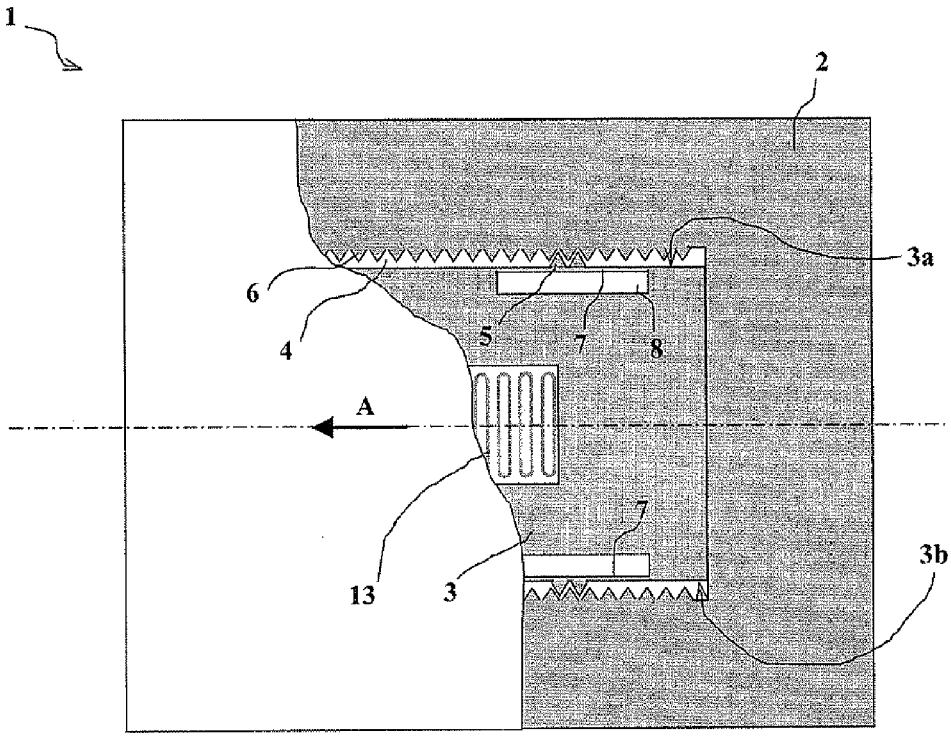
FIG. 1 schematically shows a first embodiment of a time control device according to the invention and incorporating a counterweight that is mobile in translation on a substrate.

FIG. 1 shows a simplified view of part of a micro-machined or micro-engraved time control device 1 using MEMS production techniques well known to one skilled in the art.

This device is incorporated into a micro-mechanism (not shown) that is more complex and is intended to ensure certain function (sensor, accelerometer, inertial unit, safety and arming device).

The other components of this micro-mechanism are not illustrated since they do not form the subject of the present invention whose description will be limited to that of the functioning of the time control device alone.

The micro-mechanism will incorporate, in particular, a mobile counterweight 3.

For the sake of clarity, FIG. 1 merely illustrates a substrate 2 with respect to which a counterweight 3 is displaced in a housing 4. The counterweight is mobile with respect to the substrate following direction 1, through the action, for example, of a motor or actuator (such as a spring 13) or else via the effect of the acceleration stress to which said counterweight is subjected (in particular when the device is a safety and arming device incorporated into a projectile).

In this latter case, depending on the orientation of the device 1, the acceleration of the counterweight must thus be the longitudinal acceleration due to firing or else the projectile's axial spin acceleration.

The counterweight 3 slides in a housing 4 which may be made in the substrate 2 itself (as shown here) or else in another element of the device which will itself be mobile.

The counterweight 3 incorporates two lateral faces 3*a*, 3*b* which have reliefs or indentations 5 intended to cooperate with other reliefs or indentations 6 on the walls of the housing 4.

The cooperation of these indentations 5 and 6 enables the counterweight's movement to be slowed down. Here, the indentations are triangular in profile. It would naturally be possible for indentations of different profiles to be implemented: rounded, rectangular, trapezoidal, etc.

In the remainder of the description, the term "indentation" will be used as, but not limited to, a generic term to designate these matching teeth or reliefs whatever the shape or number of such indentations.

According to an essential characteristic of the invention, certain of the neighbouring indentations of each lateral face 3*a*, 3*b* of the counterweight will be integral with a flexible tongue 7, itself integral with the element carrying these indentations. Here, the indentations integral with a tongue 7 are carried by the counterweight 3 itself.

This flexible tongue 7 is delimited by the engraving of an opening 8 in the counterweight 3. The tongue 7 is integral with the counterweight by its two ends. Such an arrangement rigidifies the tongue. It further enables the device to be made reversible; braking can thus be performed in the two opposing directions of movement of the counterweight with respect to its housing. Such an arrangement may be useful in a configuration which will be described later will reference to FIG. 5.

Figure 2:
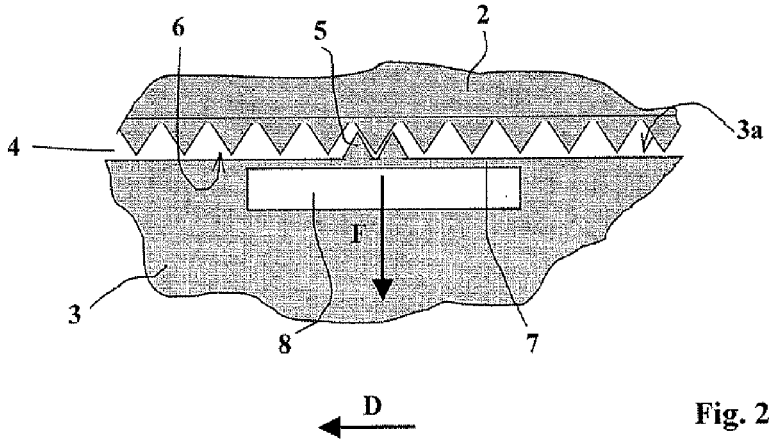
FIG. 2 shows an enlarged view illustrating the cooperation of the indentations in this first embodiment.

As can be more clearly seen in FIG. 2, when the counterweight 3 is displaced (arrow D) further to the action of a motor or to inertial stresses associated with acceleration, the indentations 6 of the substrate 2 push the indentations 5 of the counterweight 3. The resulting friction stress causes the tongue 7 to bend and push the indentations 5 of the counterweight 3 away from those 6 of the substrate 2, in a direction perpendicular to direction D (arrow F). The displacement of the counterweight is thus made possible thanks to the flexibility of the tongues 7 located on either side of the counterweight 3, whereas the play between the counterweight 3 and its housing 4 is reduced.

The indentations 6 of the substrate are in fact practically in contact with the lateral walls 3*a*, 3*b* of the counterweight. Note that, with such reduced play, it would be impossible for the counterweight 3 to move in a zigzag (as for known devices). Furthermore, since the indentations on each lateral face 3*a*, 3*b* of the counterweight are symmetrical, the displacement of the counterweight 3 is made in a straight line in the housing 4.

The delaying of the movement of the counterweight thus results here from the braking due to the friction of the indentations 5 and 6 against one another. The rectilinear displacement is well controlled and the delay will depend on the flexibility of the tongues 7 as well as on the number of indentations 5 and 6 in contact with one another, that is to say on the intensity of the friction stress. These parameters can be easily controlled. As a result, the delay has excellent reliability and reproducibility.

Figure 3:
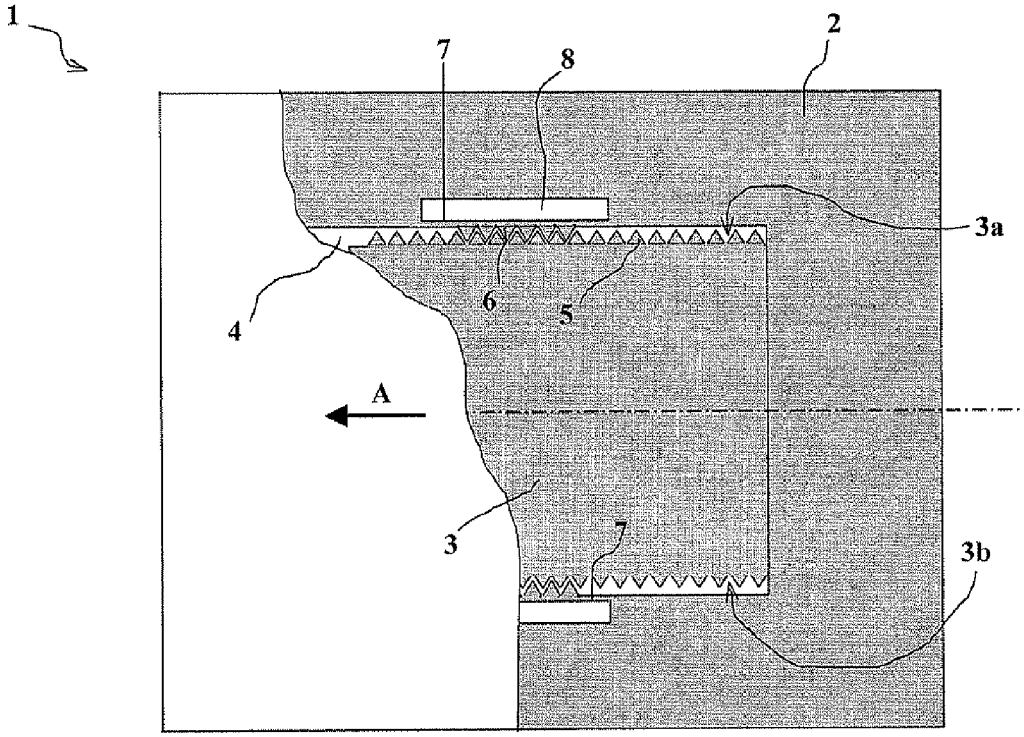
FIG. 3 shows a second embodiment of a time control device incorporating a counterweight mobile in translation on a substrate.

FIG. 3 shows another embodiment of the invention in which the indentations 5 on the two lateral walls 3*a*, 3*b* of the counterweight 3 are immobile.

They cooperate with indentations 6 integral with a flexible tongue 7 on the walls of the housing 4.

Figure 4:
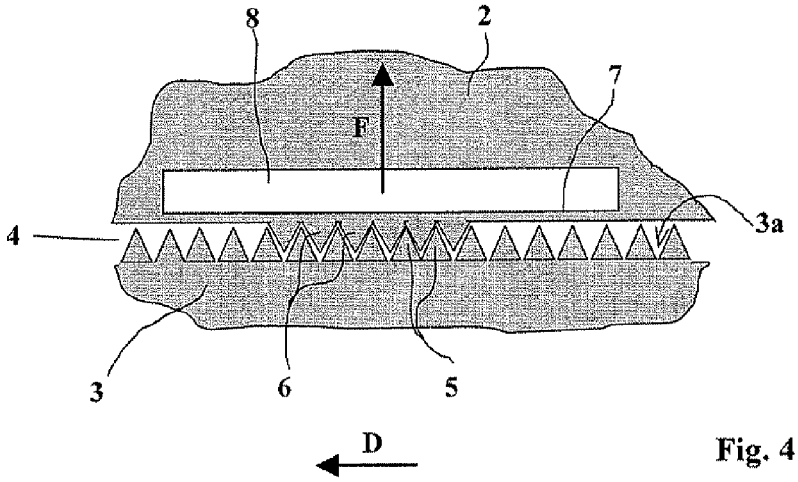
FIG. 4 shows an enlarged view illustrating the cooperation of the indentations in this second embodiment.

FIG. 4 is an enlarged view of a detail showing the cooperation between the indentations in this embodiment.

Functioning is analogous to that shown with reference to FIGS. 1 and 2.

When the counterweight 3 is displaced (arrow D) the indentations 5 of the counterweight 3 push those 6 of the substrate 2. The resulting friction stresses cause the tongue 7 to bend and push the indentations 6 of the substrate 2 away from those 5 of the counterweight 3, in a direction perpendicular to direction D (arrow F). The displacement of the counterweight is, once again, made possible by the flexibility of the tongues 7 located on the walls of the housing 4, on either side on the counterweight 3.

Figure 5:
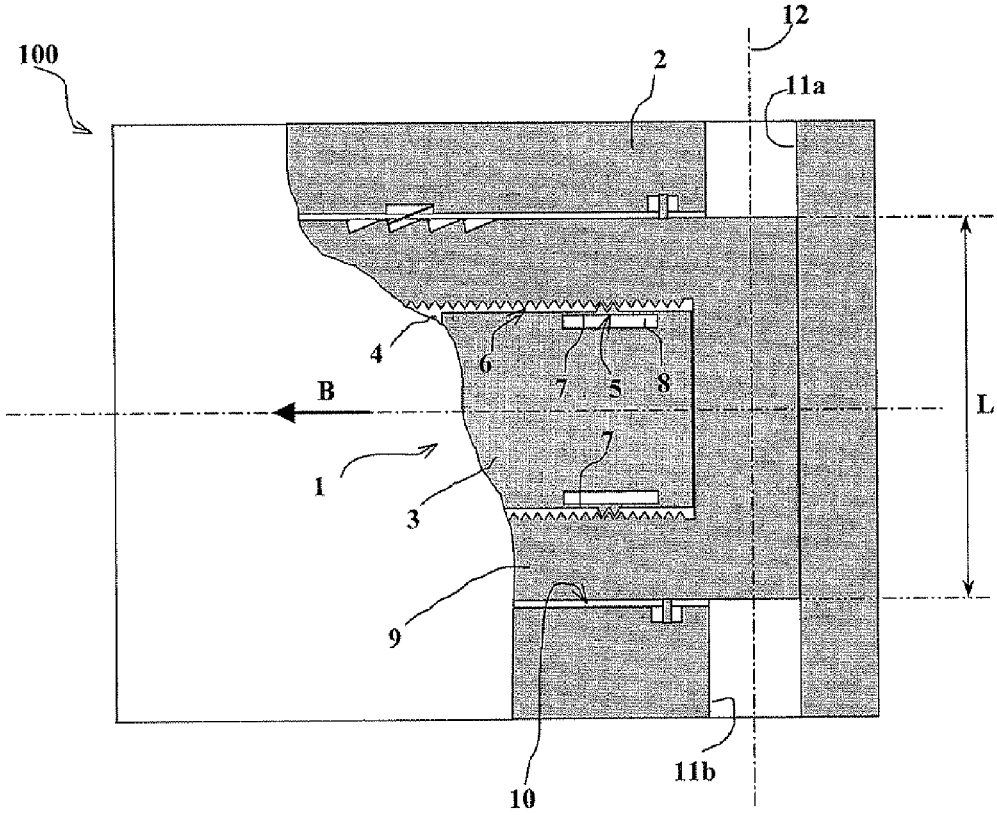
FIG. 5 is a schematic view of one embodiment of a safety and arming device incorporating a time control device in which the counterweight slides with respect to a shutter to break the pyrotechnic train.

FIG. 5 shows an example application in which the time control device 1 is incorporated into a micro-machined or micro-engraved safety and arming device 100.

This device 100 incorporates a shutter 9 to break the pyrotechnic train. This shutter 9 is itself mobile in translation on the substrate 2 in a cavity 10. An arrow B is shown in FIG. 5 to indicate the direction of displacement of the shutter 9 during arming.

FIG. 5 also shows openings 11*a* and 11*b* that are arranged on either side of the shutter 9 as well as the axis 12 of these openings (thus the direction of action of the pyrotechnic train). This direction 12 is perpendicular to the direction of displacement B of the shutter 9 and is the same as the axis of a projectile (not shown) inside which the device is positioned.

By way of illustration without limitation, a device is shown here in which the direction of action 12 of the pyrotechnic train is substantially parallel to the plane of the shutter. These devices are disclosed by patents EP1780496 and EP2077431.

The dimension L of the shutter 9 thus ensures here the interruption of the pyrotechnic train in the safety position of the device 100.

This safety and arming device 100 naturally also comprises other elements, such as one or several locks for the shutter 9 that are released by the longitudinal acceleration and possibly by the projectile's spin. These elements do not form part of the invention and do not need to be described in detail. Reference may be made to the patents described in the preamble to the present application (and in particular to EP1780496 or EP2077431) to obtain details of the structures of different embodiments of the safety and arming devices to which the invention may be applied.

According to the embodiment shown in FIG. 5, the shutter 9 incorporates a housing 4 inside which a counterweight 3 slides. This counterweight 3 mounted sliding in the same direction B as the arming direction of the shutter 9 will thus be subjected to centrifugal inertial forces for this device which is intended to be incorporated into a spin-stabilised projectile.

The counterweight 3 is intended to lift a centrifugal lock of the shutter 9. This lock is not shown since it does not form part of the present invention. Reference may be made, for example, to patent EP2077431 which discloses one example of a centrifugal lock for an analogous configuration of a safety and arming device.

In FIG. 5 it can be observed that the counterweight 3 incorporates indentations 5 integral with a flexible blade 7. These indentations cooperate with the indentations 6 on the internal wall of the housing 4 of the counterweight. The configuration adopted here for the braking means of the counterweight is thus identical to that described previously with reference to FIGS. 1 and 2.

It would naturally be possible, between the shutter 9 and the counterweight 3, to implement a configuration of the time control device 1 analogous to that described with reference to FIGS. 3 and 4.

It can be noted that in the embodiment according to FIG. 5, and in which the shutter 9 and counterweight 3 have the same direction of displacement B, the braking means of the displacement of the counterweight 3 via the indentations in the shutter 9 act symmetrically as the braking means for the displacement of the shutter 9 via the indentations of the counterweight. This displacement is made possible since the tongue 7 is integral with the counterweight 3 by its two ends. This arrangement, which makes the movements of the device reversible, has been described previously.

Such an arrangement is particularly advantageous since it reduces the shocks on the shutter during arming and thus the risks of the shutter 9 rebounding.

FIG. 1 shows a spring 13 positioned between the substrate 2 and the counterweight 3.

It can be noted that this spring has been omitted from FIGS. 3 and 5. With the invention it is, in fact, no longer necessary to resort to a spring to preserve the alignment of the counterweight and to overcome the problems due to the relative play between the counterweight and its housing. For this it merely requires the tongue 7 to be sufficiently stiff for it not to bend during the shocks encountered during the transport and positioning phases of the projectile.

The tongue 7 will, however, be dimensioned to bend when friction stresses are caused by extreme acceleration due to firing. In this way, with the invention, the cooperation of the indentations 5, 6 between the counterweight 3 and the walls of its housing 4 may act as a lock for the counterweight 3 thereby further simplifying the design of a safety and arming device. This naturally depends on the acceleration conditions which must be withstood by the device during the logistic and firing phases.

By way of a variant, it is naturally possible to provide more than one tongue in the vicinity of each lateral face of the counterweight.

Figure 6A:
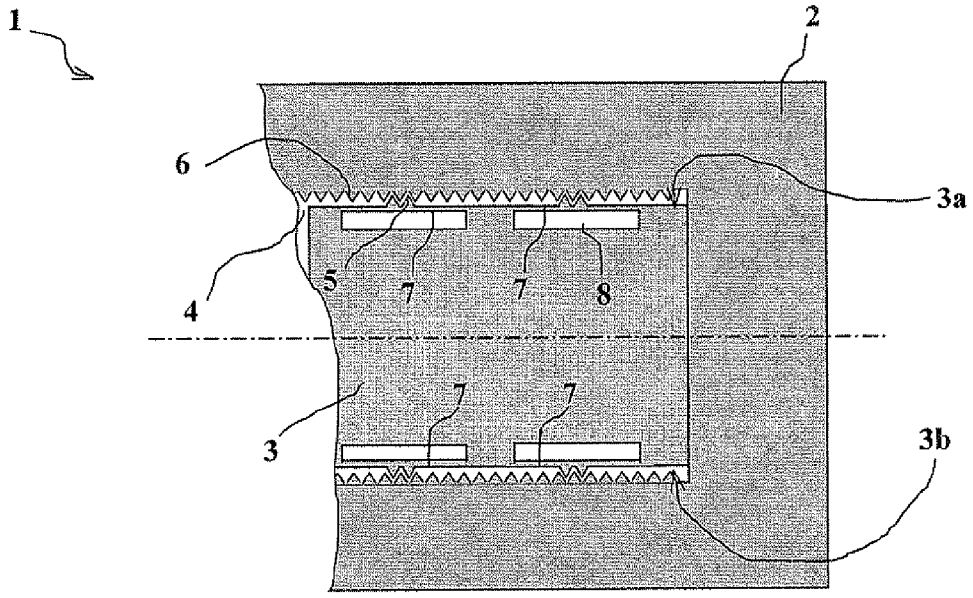
FIGS. 6*a* and 6*b* show two variant embodiments of a time control device according to the invention.
Figure 6B:
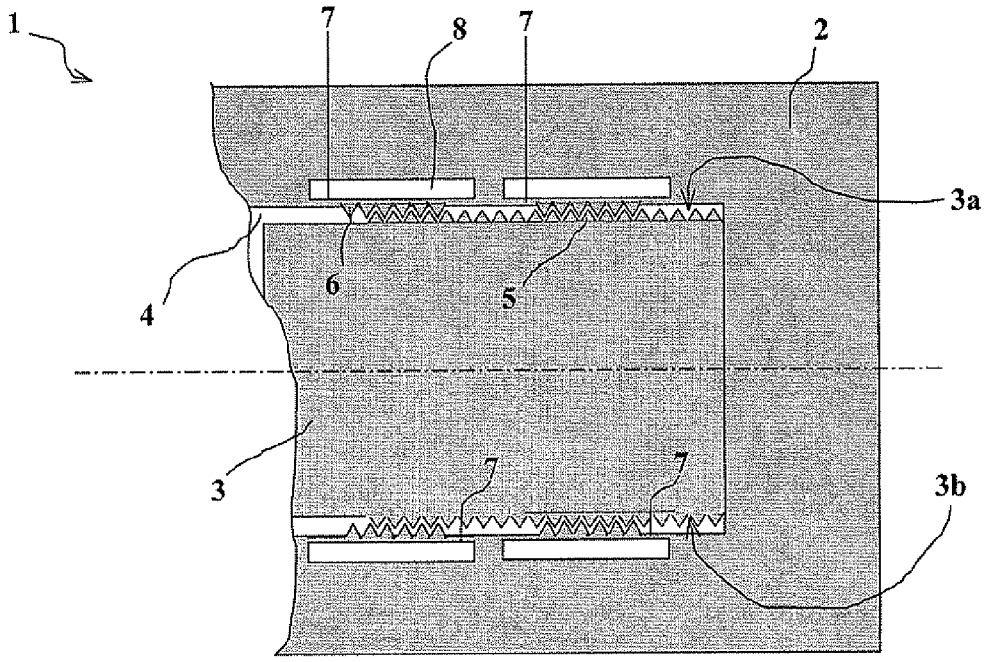

By way of example, FIG. 6*a* thus shows a time control device 1 in which a counterweight 3 incorporates two flexible tongues 7 on each wall 3*a*, 3*b* of the counterweight 3 and FIG. 6*b* shows a counterweight 3 that is displaced in a housing whose walls, near to the lateral walls 3*a*, 3*b* of the counterweight, each carry two flexible tongues 7 with indentations 6.

The time control device according to the invention may also be implemented to delay or slow down a pivoting motion of a counterweight.

Figure 7A:
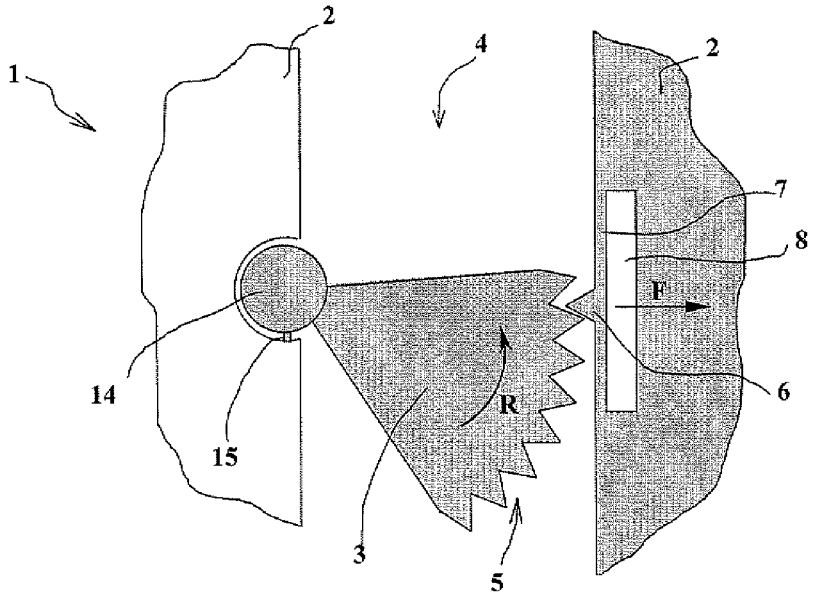
FIGS. 7*a* and 7*b* show a third embodiment of a time control device incorporating a counterweight mobile in translation on a substrate.
Figure 7B:
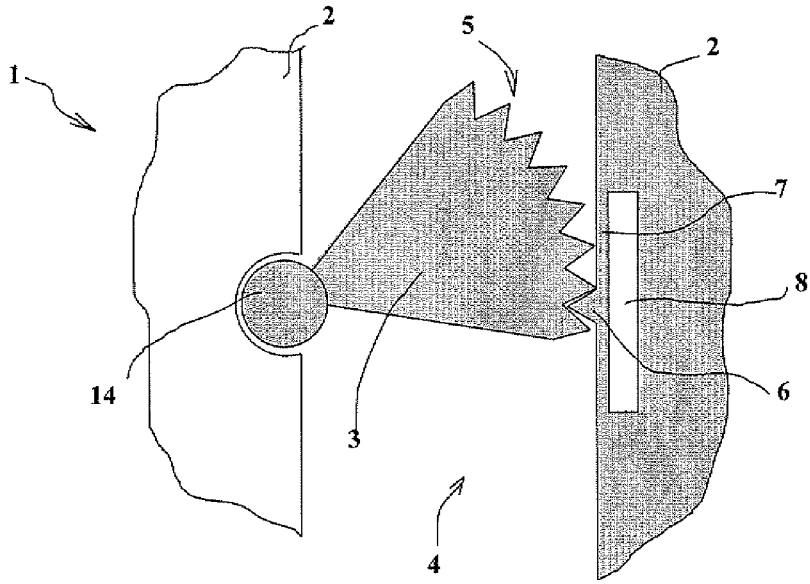

FIGS. 7*a* and 7*b* schematically show a micro-machined or micro-engraved time control device 1 in which the counterweight 3 is mounted able to pivot in a housing 4 with respect to a substrate 2 and on a pivot 14. The counterweight 3 is here in the shape of a sector whose external edge has indentations 5. Such a counterweight may, for example, constitute a lock for a micro-machined device. In this case, it cooperates at the end of its stroke with other organs or mechanisms which are not shown here since they do not form part of the present invention.

The indentations 5 cooperate with a single indentation 6 integral with a flexible tongue 7, itself integral with the substrate 2 and delimited by an opening 8.

It can be observed in FIG. 7*a* that the pivot 14 is locked with respect to the substrate 2 by a breakable strip 15. A pivoting torque exerted on the shutter 3 to make it turn following arrow R (for example further to an inertial stress) will cause the strip 15 to break.

Pivoting in the direction indicated by arrow R will be slowed down by the indentation 6 integral with the substrate 2. The friction stresses between the indentations 5 and 6 will bend the tongue 7, whose flexibility will allow the counterweight 3 to pivot. The arrow F in FIG. 7*a* represents the bending stress exerted on the tongue 7.

The braking of the counterweight 3 is thus a result of the friction of the indentations 5 and 6 on one another. The delay thus depends on the flexibility of the tongue 7 and on the number of indentations in contact with one another (here, only one). These parameters can be easily controlled, resulting in the excellent reliability and reproducibility of the delay. FIG. 7*b* shows the position of the counterweight 3 after its pivoting. It can be noted that the indentation 6 ensures the counterweight 3 is held in position after this pivoting movement. This holds true for as long as the accelerations to which it is subjected thereafter are less than those required to bend the tongue. Otherwise, locking means need to be provided (not shown).

Naturally the embodiments of the time control device described previously can be used in all types of micro-mechanical devices using MEMS technology in which it is necessary to slow down or delay a rotational or translational displacement of a counterweight. The field of application of the invention is thus not limited to that of safety and arming devices for pyrotechnic trains of projectiles.

What is claimed is:

1. A time control device for the movement of a micro-machined or micro-engraved counterweight with respect to a substrate, wherein said counterweight moves in a housing, wherein said counterweight comprises at least one face having at least one first indentation intended to cooperate with at least one second indentation on said housing so as to ensure the delaying of said movement of said counterweight, wherein at least one first flexible tongue is delimited in said counterweight by at least one first opening engraved in said counterweight or at least one second flexible tongue is delimited in said housing by at least one second opening engraved in said housing, wherein said first indentation on said counterweight is made on at least one of said first flexible tongue or said second indentation on said housing is made on at least one of said second flexible tongue, said first or second flexible tongue being able to be deformed by bending during the displacement of said counterweight.

2. A time control device according to claim 1, wherein said first flexible tongue is integral with said counterweight by its two ends or said second flexible tongue is integral with said housing by its two ends.

3. A time control device according to claim 1, wherein said counterweight is mobile in translation in said housing, wherein said counterweight comprises two lateral faces each having at least one first indentation each intended to cooperate with at least one second indentation on the walls of said housing, wherein at least said first indentations of said counterweight are made on said at least one first flexible tongue or said second indentations of said housing are made on said at least one second flexible tongue.

4. A time control device according to claim 1, wherein said first indentation on said counterweight is made on two of said first flexible tongue or said second indentation on said housing is made on two of said second flexible tongue.

5. A time control device according to claim 1, wherein said counterweight is mobile in rotation in relation to said housing, wherein said counterweight comprises a sector with said first indentation cooperating with said second matching indentation of said housing, wherein said second indentation on said housing is made on said second flexible tongue.

6. A time control device according to claim 2, wherein said counterweight is mobile in translation in said housing, wherein said counterweight comprises two lateral faces having at least one first indentation each intended to cooperate with at least one second indentation on the walls of the housing, wherein at least said first indentations of said counterweight are made on said at least one first flexible tongue or said second indentations of said housing are made on said at least one second flexible tongue.

7. A safety and arming device for a pyrotechnic train of a projectile to which a longitudinal acceleration movement and an axial spin are imparted upon firing, comprising a time control device for the movement of a micro-machined or micro-engraved counterweight with respect to a substrate, wherein said counterweight moves in a housing, wherein said counterweight comprises at least one face having at least one first indentation intended to cooperate with at least one second indentation on said housing so as to ensure the delaying of said movement of said counterweight, wherein at least one first flexible tongue is delimited in said counterweight by at least one first opening engraved in said counterweight or at least one second flexible tongue is delimited in said housing by at least one second opening engraved in said housing, wherein said first indentation on said counterweight is made on at least one of said first flexible tongue or said second indentation on said housing is made on at least one of said second flexible tongue, said first or second flexible tongue being able to be deformed by bending during the displacement of said counterweight.

8. A safety and arming device according to claim 7, wherein said housing is arranged in a shutter intended to break said pyrotechnic train.

* * * * *